US012746450B2

(12) United States Patent
Chen

(10) Patent No.: US 12,746,450 B2
(45) Date of Patent: Sep. 29, 2026

(54) PRENATAL ACTIVITY ASSISTANCE DEVICE

(71) Applicant: The Third Affiliated Hospital, Guangzhou Medical University (GZ Critical Pregnant Women Center), Guangzhou (CN)

(72) Inventor: Chen Chen, Guangzhou (CN)

(73) Assignee: The Third Affiliated Hospital, Guangzhou Medical University (GZ Critical Pregnant Women Center), Guangzhou (CN)

( * ) Notice: Subject to any disclaimer, the term of this patent is extended or adjusted under 35 U.S.C. 154(b) by 0 days.

(21) Appl. No.: 19/149,486

(22) PCT Filed: Jul. 3, 2024

(86) PCT No.: PCT/CN2024/103236
§ 371 (c)(1),
(2) Date: Jul. 18, 2025

(87) PCT Pub. No.: WO2024/193735
PCT Pub. Date: Sep. 26, 2024

(65) Prior Publication Data

US 2026/0115576 A1 Apr. 30, 2026

(51) Int. Cl.
*A63B 71/12* (2006.01)
*A63B 22/00* (2006.01)
(Continued)

(52) U.S. Cl.
CPC ..... *A63B 71/12* (2013.01); *A63B 22/0046* (2013.01); *A63B 22/02* (2013.01);
(Continued)

(58) Field of Classification Search
CPC . A63B 22/02; A63B 22/0046; A63B 71/0054; A63B 71/12; A63B 71/1225
See application file for complete search history.

(56) References Cited

U.S. PATENT DOCUMENTS 9,370,680 B1 * 6/2016 Macaulay ..... A63B 71/023
10,493,309 B2 * 12/2019 Jue ..... A63B 21/00069

FOREIGN PATENT DOCUMENTS

CN 202070074 U 12/2011
CN 105056470 A 11/2015
(Continued)

*Primary Examiner* — Joshua T Kennedy

(74) *Attorney, Agent, or Firm* — Rondaus PLLC; George Liu

(57) ABSTRACT

A prenatal activity assistance device comprises a treadmill, wherein a waist pressure relief mechanism is fixedly connected to a top wall of each of two side support frames of the treadmill, a balance adjustment mechanism is fixedly connected between the two side support frames of the treadmill, and a foot anti-sprain mechanism is fixedly connected to a bottom wall of each of the two side support frames of the treadmill; and the waist pressure relief mechanism comprises a first square housing, an outer wall of the first square housing is fixedly connected to a support frame of the treadmill, a first sliding block is slidably inserted into an inner portion of the first square housing, and a first spring is fixedly connected between an outer wall of the first sliding block and an inner wall of the first square housing. Through sliding movement of the first sliding block within the first square housing, the device adapts to pregnant women of different heights wearing the shoulder strap, effectively improving adaptability. Furthermore, rebound of the first spring generates an upward lifting force. During strolling, this force adjusts the posture of the pregnant woman, effectively reducing lumbar pressure.

8 Claims, 8 Drawing Sheets

(51) Int. Cl.
*A63B 22/02* (2006.01)
*A63B 71/00* (2006.01)

(52) U.S. Cl.
CPC ..... *A63B 71/0054* (2013.01); *A63B 71/1225* (2013.01); *A63B 2071/1208* (2013.01); *A63B 2071/1283* (2013.01); *A63B 2225/09* (2013.01)

(56) References Cited

FOREIGN PATENT DOCUMENTS

| | | | | | |
|---|---|---|---|---|---|
| CN | 204864718 | U | * | 12/2015 | |
| CN | 208741836 | U | * | 4/2019 | |
| CN | 209809473 | U | | 12/2019 | |
| CN | 111840901 | A | * | 10/2020 | ..... A61G 5/00 |
| CN | 113559458 | A | * | 10/2021 | ..... A63B 22/025 |
| CN | 115990330 | A | | 4/2023 | |
| CN | 116688430 | A | | 9/2023 | |
| CN | 118267688 | A | * | 7/2024 | ..... A63B 23/18 |
| CN | 118662849 | A | * | 9/2024 | ..... A63B 71/12 |
| KR | 100718059 | B1 | * | 5/2007 | ..... A01K 15/027 |
| WO | 2020190218 | A1 | | 9/2020 | |

* cited by examiner

PRENATAL ACTIVITY ASSISTANCE DEVICE

TECHNICAL FIELD

The present disclosure relates to the technical field of obstetrics, and in particular to a prenatal activity assistance device.

BACKGROUND

With the increasing awareness of prenatal health, a growing number of pregnant women choose to engage in appropriate physical activities before delivery to enhance physical fitness, promote blood circulation, alleviate pregnancy discomfort, and prepare for childbirth. Among these activities, slow walking or strolling on a treadmill is a common exercise method. However, safety risks exist for pregnant women using treadmills, particularly when balance capability declines or physical discomfort occurs.

Current treadmills on the market are primarily designed for general adults and lack specific adaptations for pregnant women. When using treadmills, pregnant women face the primary safety issue of absent effective fall-prevention devices. Due to changes in body weight distribution, lower limb edema, joint laxity, and other factors during pregnancy, pregnant women may experience instability while walking on treadmills, creating a risk of falling.

SUMMARY

To overcome the above technical deficiencies, the object of the present disclosure is to provide a prenatal activity assistance device. Through sliding movement of the first sliding block within the first square housing, the device adapts to pregnant women of different heights wearing the shoulder strap, effectively improving adaptability. Furthermore, rebound of the first spring generates an upward lifting force. During strolling, this force adjusts the posture of the pregnant woman, effectively reducing lumbar pressure. By allowing sliding movement of the shoulder strap within the range of the first sliding rail, the device significantly expands the shoulder movement space of the pregnant woman. This design prevents the shoulder strap from being fixed at a single position. During exercise, a fixed-position shoulder strap could easily drag the upper body, compromising personal safety and reducing comfort. The present disclosure effectively enhances safety for pregnant women during exercise.

A prenatal activity assistance device, comprising a treadmill, wherein a waist pressure relief mechanism is fixedly connected to a top wall of each of two side support frames of the treadmill, a balance adjustment mechanism is fixedly connected between the two side support frames of the treadmill, and a foot anti-sprain mechanism is fixedly connected to a bottom wall of each of the two side support frames of the treadmill; and the waist pressure relief mechanism comprises a first square housing, an outer wall of the first square housing is fixedly connected to a support frame of the treadmill, a first sliding block is slidably inserted into an inner portion of the first square housing, and a first spring is fixedly connected between an outer wall of the first sliding block and an inner wall of the first square housing.

Further, a first spring telescopic tube is fixedly connected to the outer wall of the first sliding block, one end of the first spring telescopic tube is fixedly connected to a first sliding rail, a square rod is slidably inserted into an inner portion of the first sliding rail, and one end of the square rod is fixedly connected to a shoulder strap.

Further, one end of the square rod is rotatably connected to a telescopic rod, one end of the telescopic rod is rotatably connected to a telescopic handle, a fixed base is fixedly connected to an outer wall of one end of the telescopic handle, and an outer wall of the fixed base is fixedly connected to the support frame of the treadmill.

Further, a first insertion pin is slidably inserted into a sleeve end of the telescopic handle, a plurality of first circular holes are provided on an outer wall of a handle rod of the telescopic handle at equal intervals, and an outer wall of the first insertion pin is slidably inserted into the first circular holes.

Further, the balance adjustment mechanism comprises four second sliding rails, an outer wall of each of the second sliding rails is fixedly connected to the support frame of the treadmill, a second sliding block is slidably inserted into an inner portion of two of the second sliding rails, a plurality of second circular holes are provided on both side outer walls of each of the second sliding rails at equal intervals, and a second insertion pin is slidably inserted between the second circular holes and the second sliding block.

Further, a second square housing is slidably inserted into an inner portion of the other two second sliding rails, the second insertion pin is slidably inserted into an outer wall of the second square housing, a second spring telescopic tube is fixedly connected to a top wall of an inner portion of the second square housing, one end of the second spring telescopic tube is fixedly connected to a square block, an outer wall of the square block is slidably inserted into the inner portion of the second square housing, the outer wall of the square block is fixedly connected to a second traction rope, an outer wall of the second sliding block is fixedly connected to a first traction rope, and a gauze is fixedly connected between one end of the two first traction ropes and one end of the two second traction ropes.

Further, two arc-shaped holes are provided at one end of the gauze at equal intervals, a first fastening strap is fixedly connected to both ports of each of the arc-shaped holes, a first socket is fixedly connected to one end of one of the first fastening straps, a first buckle is fixedly connected to one end of the other first fastening strap, and the first socket is in insertion fit with the first buckle.

Further, the foot anti-sprain mechanism comprises a third sliding rail, an outer wall of the third sliding rail is fixedly connected to the support frame of the treadmill, a semicircular frame is slidably inserted into an inner portion of the third sliding rail, and a second spring is fixedly connected between an outer wall of the semicircular frame and an inner wall of the third sliding rail.

Further, an arc-shaped groove is provided on the outer wall of the semicircular frame, a third spring telescopic tube is slidably connected within the arc-shaped groove, two second fastening straps are fixedly connected to both sides of an outer wall of one end of the third spring telescopic tube, a second socket and a second buckle are fixedly connected to one end of the two second fastening straps respectively, and the second socket is in insertion fit with the second buckle.

Beneficial Effects of the Present Disclosure

1. An outer wall of the first square housing is fixedly connected to a support frame of the treadmill, a first sliding block is slidably inserted into an inner portion of the first square housing, and a first spring is fixedly connected between an outer wall of the first sliding block and an inner wall of the first square housing. Through sliding movement of the first sliding block within the first square housing, the device adapts to pregnant women of different heights wearing the shoulder strap, effectively improving adaptability. Furthermore, rebound of the first spring generates an upward lifting force. During strolling, this force adjusts the posture of the pregnant woman, effectively reducing lumbar pressure.

2. A first spring telescopic tube is fixedly connected to the outer wall of the first sliding block, one end of the first spring telescopic tube is fixedly connected to a first sliding rail, a square rod is slidably inserted into an inner portion of the first sliding rail, and one end of the square rod is fixedly connected to a shoulder strap. By allowing sliding movement of the shoulder strap within the range of the first sliding rail, the device significantly expands the shoulder movement space of the pregnant woman. This design prevents the shoulder strap from being fixed at a single position. During exercise, a fixed-position shoulder strap could easily drag the upper body, compromising personal safety and reducing comfort. The present disclosure effectively enhances safety for pregnant women during exercise.

3. One end of the square rod is rotatably connected to a telescopic rod, one end of the telescopic rod is rotatably connected to a telescopic handle, a fixed base is fixedly connected to an outer wall of one end of the telescopic handle, and an outer wall of the fixed base is fixedly connected to the support frame of the treadmill. Pulling the first spring telescopic tube and the telescopic handle enables sliding movement. This sliding movement drives extension of the shoulder strap, facilitating adjustment of the shoulder strap to a suitable position for wearing by the pregnant woman. Simultaneously, a handle rod of the telescopic handle extends outward, facilitating gripping by the pregnant woman during exercise, effectively improving wearing comfort and safety. Moreover, when not in use, rebound of the first spring telescopic tube returns the shoulder strap to an original position, avoiding interference with movement of the pregnant woman.

BRIEF DESCRIPTION OF THE DRAWINGS

The following describes the present disclosure in further detail with reference to the accompanying drawings.

Figure 1:
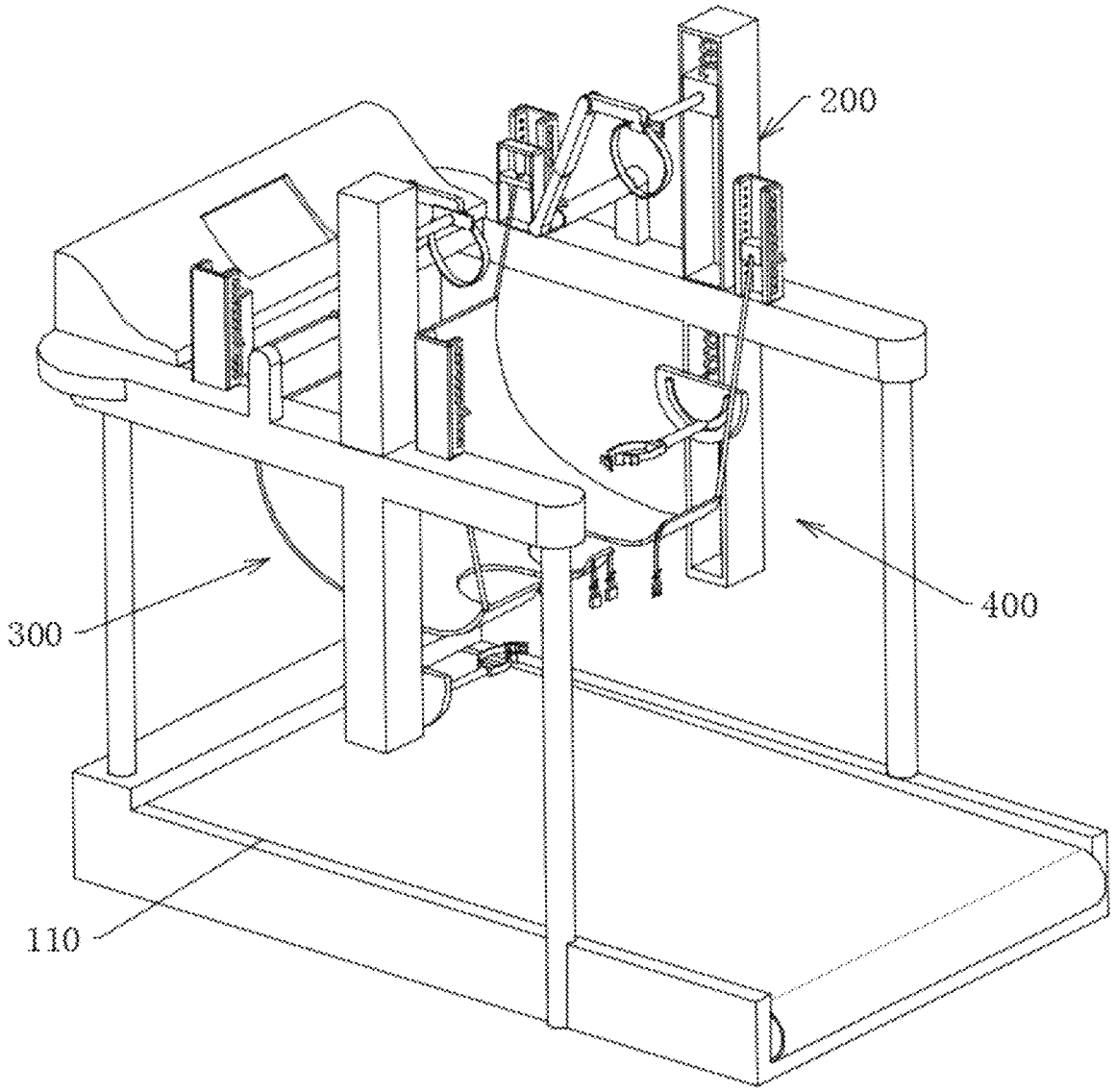
FIG. 1 is a schematic structural view of the overall device of the present disclosure.
Figure 2:
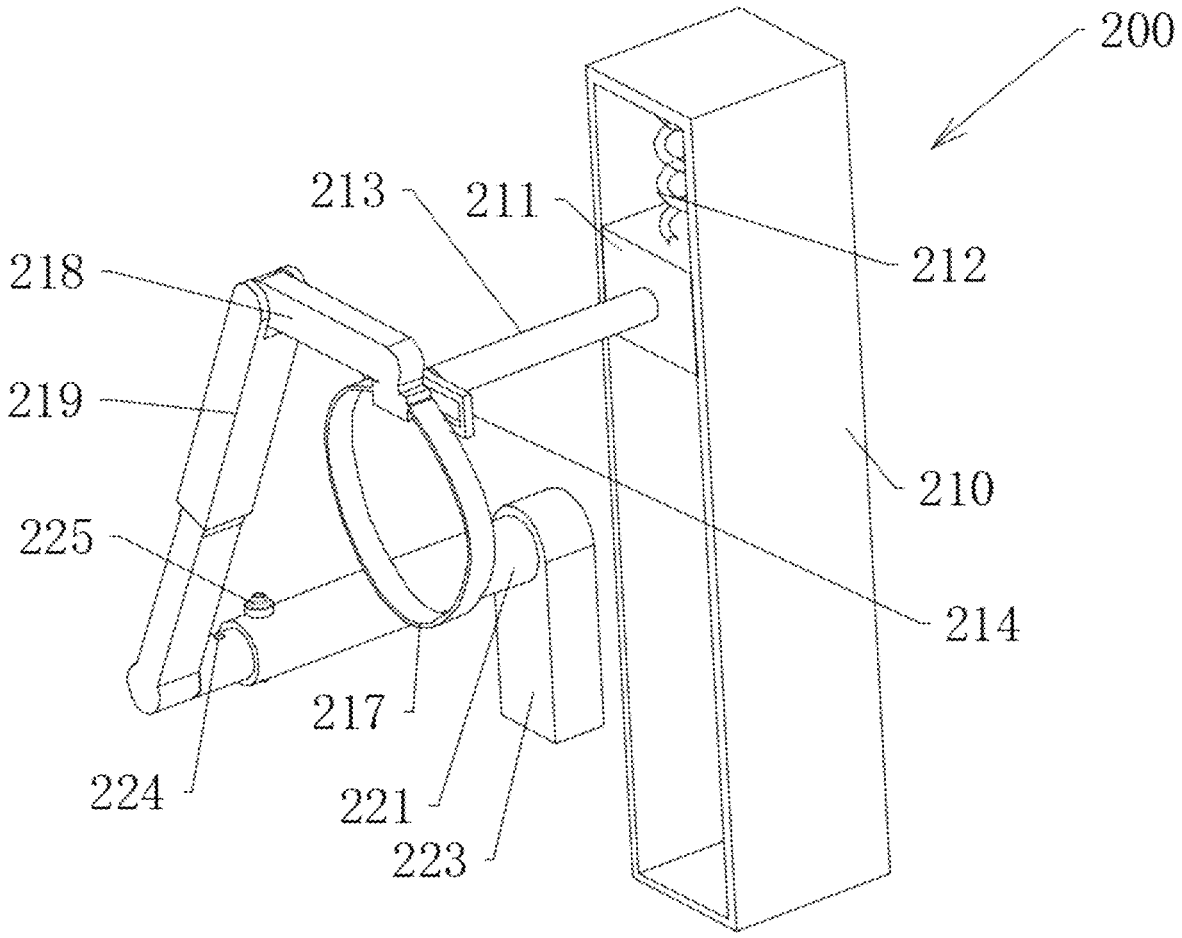
FIG. 2 is a schematic structural view of a waist pressure relief mechanism of the present disclosure.

Reference numerals in the drawings: 110, treadmill; 200, waist pressure relief mechanism; 210, first square housing; 211, first sliding block; 212, first spring; 213, first spring telescopic tube; 214, first sliding rail; 217, shoulder strap; 218, square rod; 219, telescopic rod; 221, telescopic handle; 223, fixed base; 224, first circular hole; 225, first insertion pin; 300, balance adjustment mechanism; 310, second sliding rail; 311, second circular hole; 312, second sliding block; 313, second insertion pin; 314, first traction rope; 320, second square housing; 321, square block; 322, second spring telescopic tube; 323, second traction rope; 330, gauze; 331, arc-shaped hole; 340, first fastening strap; 341, first socket; 342, first buckle; 400, foot anti-sprain mechanism; 410, third sliding rail; 412, second spring; 413, semicircular frame; 414, arc-shaped groove; 415, third spring telescopic tube; 420, second fastening strap; 421, second socket; and 422, second buckle.

DETAILED DESCRIPTION OF THE EMBODIMENTS

The technical solutions in the embodiments of the present disclosure will be clearly and completely described below with reference to the embodiments of the present disclosure. Obviously, the described embodiments are only a part of the embodiments of the present disclosure, rather than all of the embodiments. Based on the embodiments of the present disclosure, all other embodiments obtained by those of ordinary skill in the art without creative efforts fall within the scope of protection of the present disclosure.

Referring to FIGS. 1-8, a prenatal activity assistance device, comprising a treadmill 110, wherein a waist pressure relief mechanism 200 is fixedly connected to a top wall of each of two side support frames of the treadmill 110, a balance adjustment mechanism 300 is fixedly connected between the two side support frames of the treadmill 110, and a foot anti-sprain mechanism 400 is fixedly connected to a bottom wall of each of the two side support frames of the treadmill 110; and the waist pressure relief mechanism 200 comprises a first square housing 210, an outer wall of the first square housing 210 is fixedly connected to a support frame of the treadmill 110, a first sliding block 211 is slidably inserted into an inner portion of the first square housing 210, and a first spring 212 is fixedly connected between an outer wall of the first sliding block 211 and an inner wall of the first square housing 210. A first spring telescopic tube 213 is fixedly connected to the outer wall of the first sliding block 211, one end of the first spring telescopic tube 213 is fixedly connected to a first sliding rail 214, a square rod 218 is slidably inserted into an inner portion of the first sliding rail 214, and one end of the square rod 218 is fixedly connected to a shoulder strap 217. One end of the square rod 218 is rotatably connected to a telescopic rod 219, one end of the telescopic rod 219 is rotatably connected to a telescopic handle 221, a fixed base 223 is fixedly connected to an outer wall of one end of the telescopic handle 221, and an outer wall of the fixed base 223 is fixedly connected to the support frame of the treadmill 110.

A first insertion pin 225 is slidably inserted into a sleeve end of the telescopic handle 221, a plurality of first circular holes 224 are provided on an outer wall of a handle rod of the telescopic handle 221 at equal intervals, and an outer wall of the first insertion pin 225 is slidably inserted into the first circular holes 224. The balance adjustment mechanism 300 comprises four second sliding rails 310, an outer wall of each of the second sliding rails 310 is fixedly connected to the support frame of the treadmill 110, a second sliding block 312 is slidably inserted into an inner portion of two of the second sliding rails 310, a plurality of second circular holes 311 are provided on both side outer walls of each of the second sliding rails 310 at equal intervals, and a second insertion pin 313 is slidably inserted between the second circular holes 311 and the second sliding block 312. A second square housing 320 is slidably inserted into an inner portion of the other two second sliding rails 310, the second insertion pin 313 is slidably inserted into an outer wall of the second square housing 320, a second spring telescopic tube 322 is fixedly connected to a top wall of an inner portion of the second square housing 320, one end of the second spring telescopic tube 322 is fixedly connected to a square block 321, an outer wall of the square block 321 is slidably inserted into the inner portion of the second square housing 320, the outer wall of the square block 321 is fixedly connected to a second traction rope 323, an outer wall of the second sliding block 312 is fixedly connected to a first traction rope 314, and a gauze 330 is fixedly connected between one end of the two first traction ropes 314 and one end of the two second traction ropes 323. Two arc-shaped holes 331 are provided at one end of the gauze 330 at equal intervals, a first fastening strap 340 is fixedly connected to both ports of each of the arc-shaped holes 331, a first socket 341 is fixedly connected to one end of one of the first fastening straps 340, a first buckle 342 is fixedly connected to one end of the other first fastening strap 340, and the first socket 341 is in insertion fit with the first buckle 342.

The foot anti-sprain mechanism 400 comprises a third sliding rail 410, an outer wall of the third sliding rail 410 is fixedly connected to the support frame of the treadmill 110, a semicircular frame 413 is slidably inserted into an inner portion of the third sliding rail 410, and a second spring 412 is fixedly connected between an outer wall of the semicircular frame 413 and an inner wall of the third sliding rail 410. An arc-shaped groove 414 is provided on the outer wall of the semicircular frame 413, a third spring telescopic tube 415 is slidably connected within the arc-shaped groove 414, two second fastening straps 420 are fixedly connected to both sides of an outer wall of one end of the third spring telescopic tube 415, a second socket 421 and a second buckle 422 are fixedly connected to one end of the two second fastening straps 420 respectively, and the second socket 421 is in insertion fit with the second buckle 422.

Specifically, during operation, pulling the first spring telescopic tube 213 and the telescopic handle 221 enables sliding movement. This sliding movement drives extension of the shoulder strap 217, facilitating adjustment of the shoulder strap 217 to a suitable position for wearing by the pregnant woman. Simultaneously, a handle rod of the telescopic handle 221 extends outward, facilitating gripping by the pregnant woman during exercise. After wearing, the first insertion pin 225 is engaged with a corresponding first circular hole 224 to provide positional limitation. By allowing sliding movement of the shoulder strap 217 within the range of the first sliding rail 214, the device significantly expands the shoulder movement space of the pregnant woman. This design prevents the shoulder strap 217 from being fixed at a single position. During exercise, a fixed-position shoulder strap 217 could easily drag the upper body. The second sliding block 312 is slid to adjust a position of one end of the gauze 330 against the buttocks according to hip height of the pregnant woman. The second insertion pin 313 is engaged with a corresponding second circular hole 311 and the second sliding block 312 to provide fixation. The one end of the gauze 330 contacts and supports the buttocks to reduce pressure on lower limbs caused by upper body weight of the pregnant woman during exercise. A length of the first fastening strap 340 is adjusted, and the first socket 341 is engaged with the first buckle 342 in insertion fit to connect the one end of the gauze 330 into a loop for positioning and supporting the buttocks. Subsequently, the second square housing 320 is slid to conform the one end of the gauze 330 to abdominal curvature of the pregnant woman. The second insertion pin 313 is engaged with a corresponding second circular hole 311 and the second square housing 320 to provide fixation. The one end of the gauze 330 contacts and supports the abdomen to reduce burden from abdominal weight. Furthermore, the second spring telescopic tube 322 prevents excessive abdominal compression during vertical movement of the pregnant woman during exercise. Finally, the second socket 421 is engaged with the second buckle 422 in insertion fit to fix the second fastening strap 420 to a thigh of the pregnant woman. When the pregnant woman walks, the third spring telescopic tube 415 slides within the arc-shaped groove 414. When the pregnant woman lifts the leg, the pulling force of the second spring 412 effectively reduces the effort exerted by the pregnant woman, enabling the pregnant woman to move more easily. When the pregnant woman lowers the leg, the pulling force of the second spring 412 provides cushioning, ensuring that the foot lands steadily.

Embodiment 1

Figure 4:
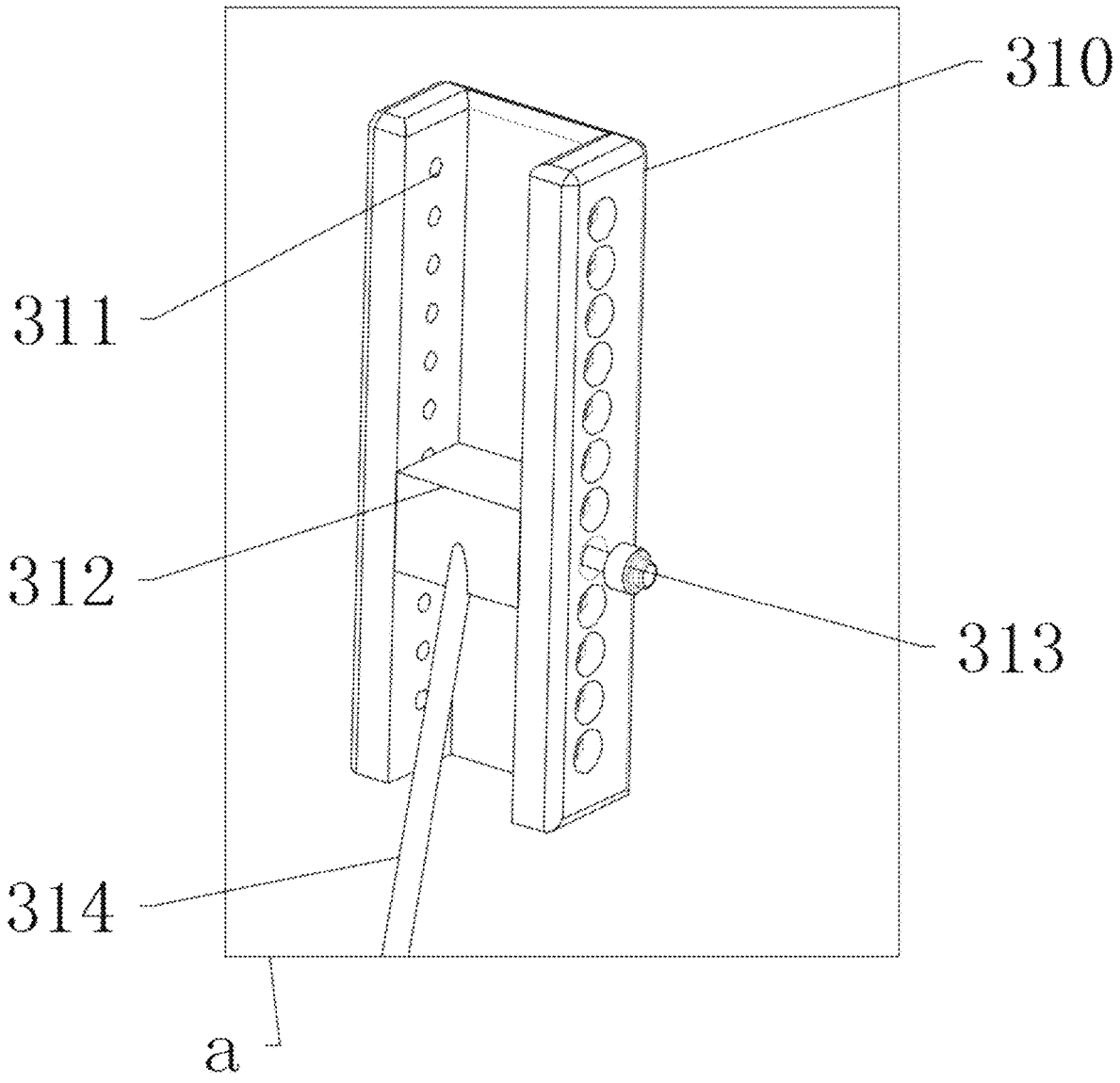
FIG. 4 is a schematic structural view of portion a in FIG. 3 of the present disclosure.

As shown in FIG. 4, in this embodiment, the balance adjustment mechanism 300 comprises four second sliding rails 310, an outer wall of each of the second sliding rails 310 is fixedly connected to the support frame of the treadmill 110, a second sliding block 312 is slidably inserted into an inner portion of two of the second sliding rails 310, a plurality of second circular holes 311 are provided on both side outer walls of each of the second sliding rails 310 at equal intervals, and a second insertion pin 313 is slidably inserted between the second circular holes 311 and the second sliding block 312.

In this embodiment, the second sliding block 312 is slid to adjust a position of one end of the gauze 330 against the buttocks according to hip height of the pregnant woman. The second insertion pin 313 is engaged with a corresponding second circular hole 311 and the second sliding block 312 to provide fixation. The one end of the gauze 330 contacts and supports the buttocks to reduce pressure on lower limbs caused by upper body weight of the pregnant woman during exercise. This improves comfort, enhances the pregnant woman's body balance, and reduces instability during standing or walking caused by weight increase.

Figure 3:
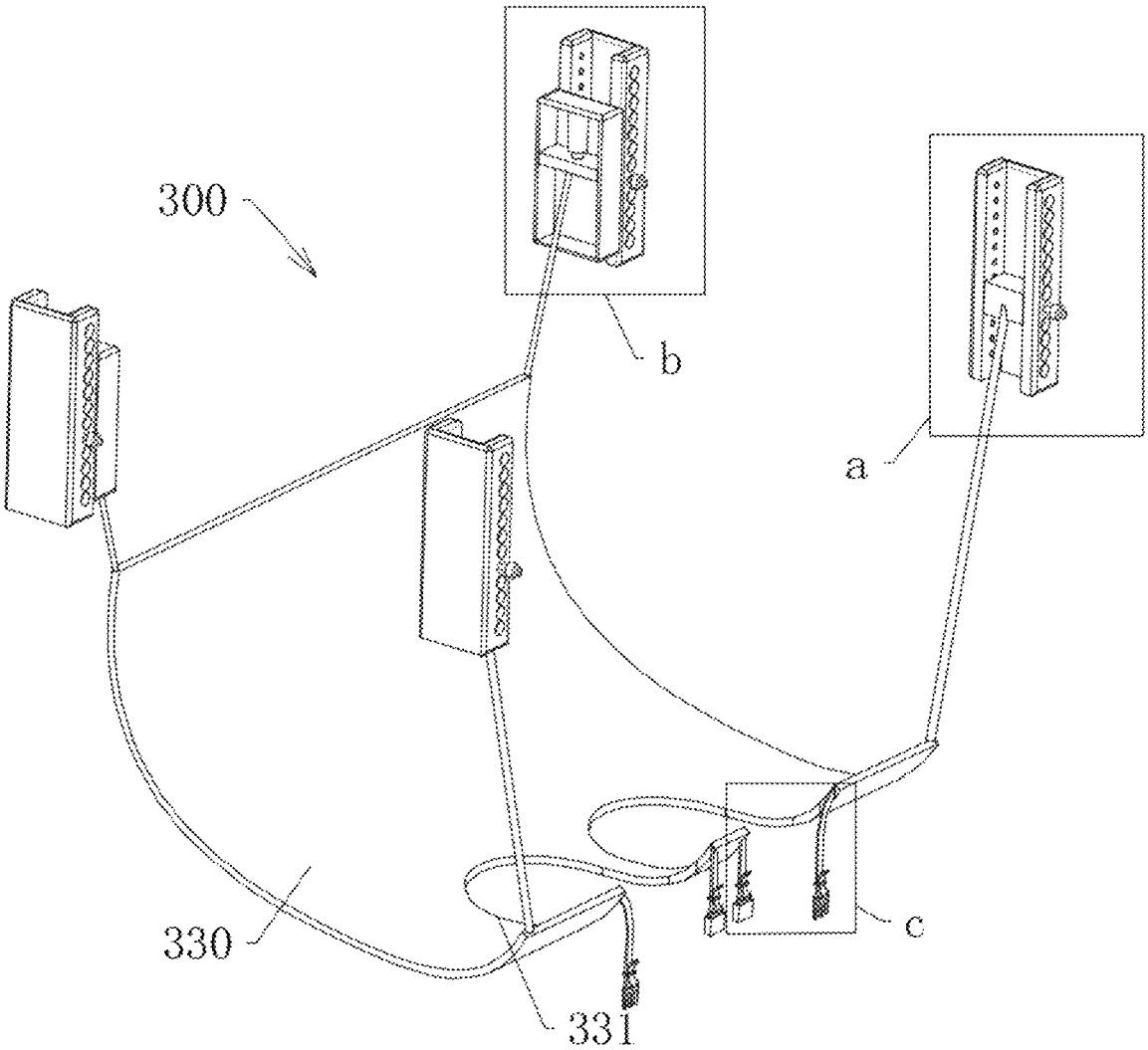
FIG. 3 is a schematic structural view of a balance adjustment mechanism of the present disclosure.
Figure 5:
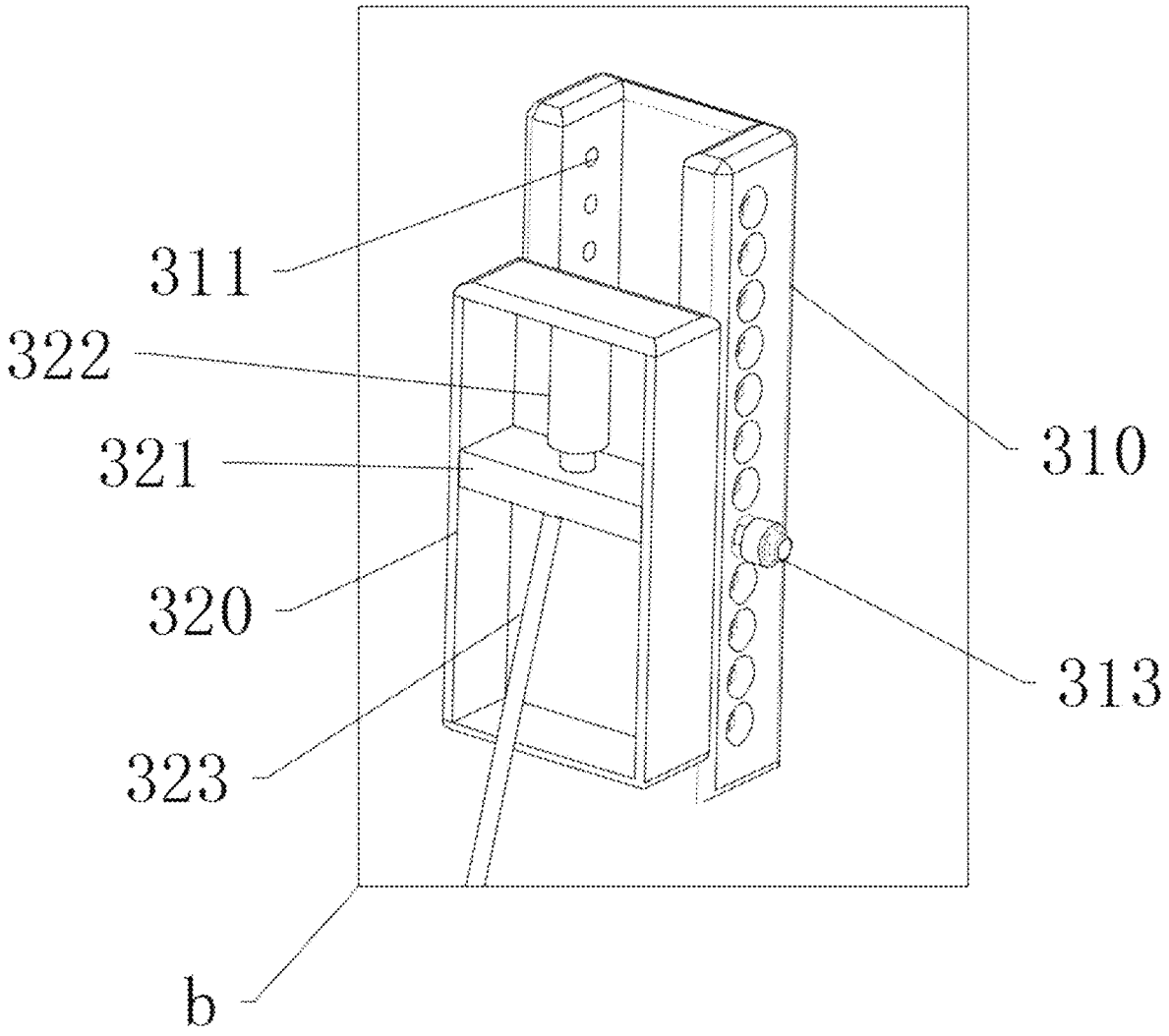
FIG. 5 is a schematic structural view of portion b in FIG. 3 of the present disclosure.
Figure 6:
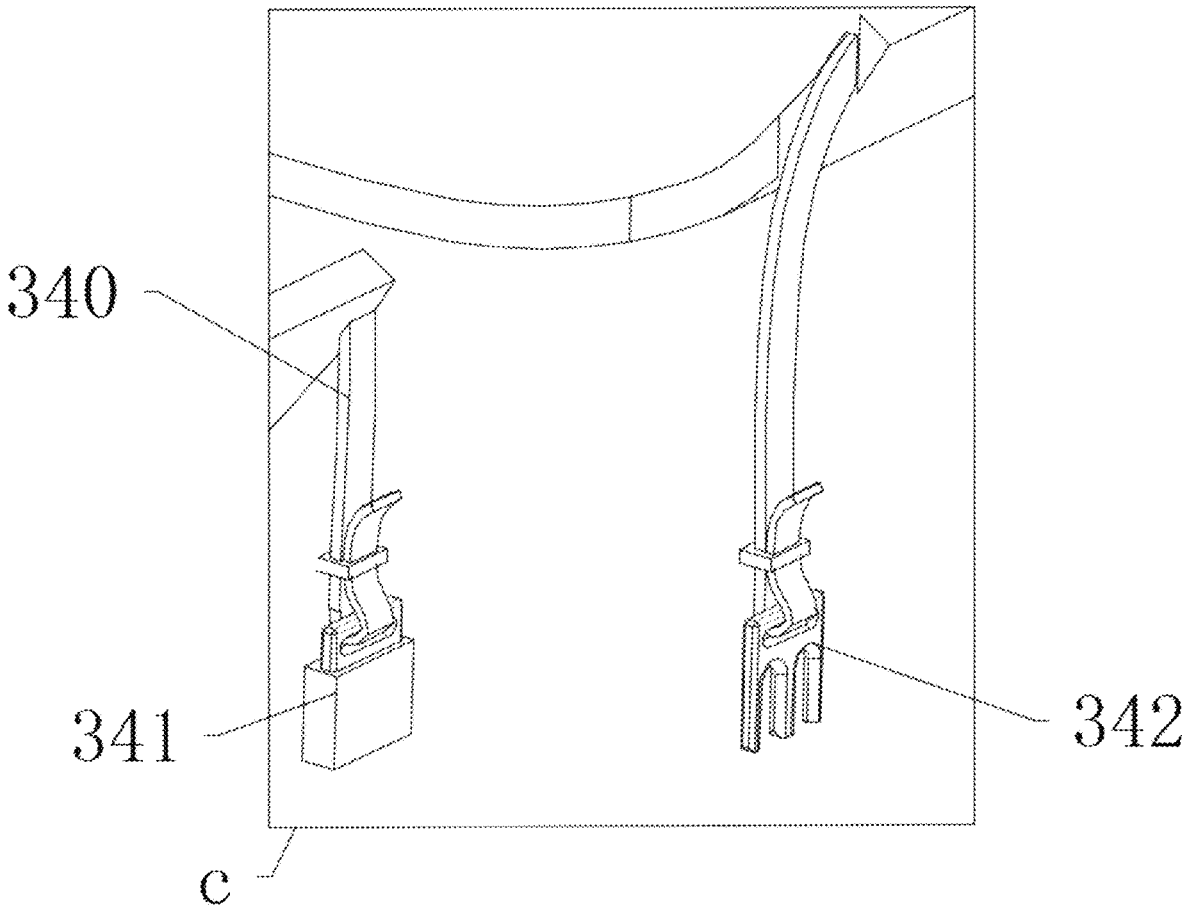
FIG. 6 is a schematic structural view of portion c in FIG. 3 of the present disclosure.

As shown in FIG. 3 and FIG. 5, in this embodiment, a second square housing 320 is slidably inserted into an inner portion of the other two second sliding rails 310, the second insertion pin 313 is slidably inserted into an outer wall of the second square housing 320, a second spring telescopic tube 322 is fixedly connected to a top wall of an inner portion of the second square housing 320, one end of the second spring telescopic tube 322 is fixedly connected to a square block 321, an outer wall of the square block 321 is slidably inserted into the inner portion of the second square housing 320, the outer wall of the square block 321 is fixedly connected to a second traction rope 323, an outer wall of the second sliding block 312 is fixedly connected to a first traction rope 314, and a gauze 330 is fixedly connected between one end of the two first traction ropes 314 and one end of the two second traction ropes 323.

During implementation, the second square housing 320 is slid to conform the one end of the gauze 330 to abdominal curvature of the pregnant woman. The second insertion pin 313 is engaged with a corresponding second circular hole 311 and the second square housing 320 to provide fixation. The one end of the gauze 330 contacts and supports the abdomen to effectively reduce burden from abdominal weight, thereby effectively alleviating instability during standing or walking caused by increased abdominal weight when the pregnant woman exercises. Furthermore, the second spring telescopic tube 322 prevents excessive abdominal compression during vertical movement of the pregnant woman during exercise, thereby avoiding discomfort from abdominal squeezing and effectively improving comfort.

Embodiment 2

Figure 7:
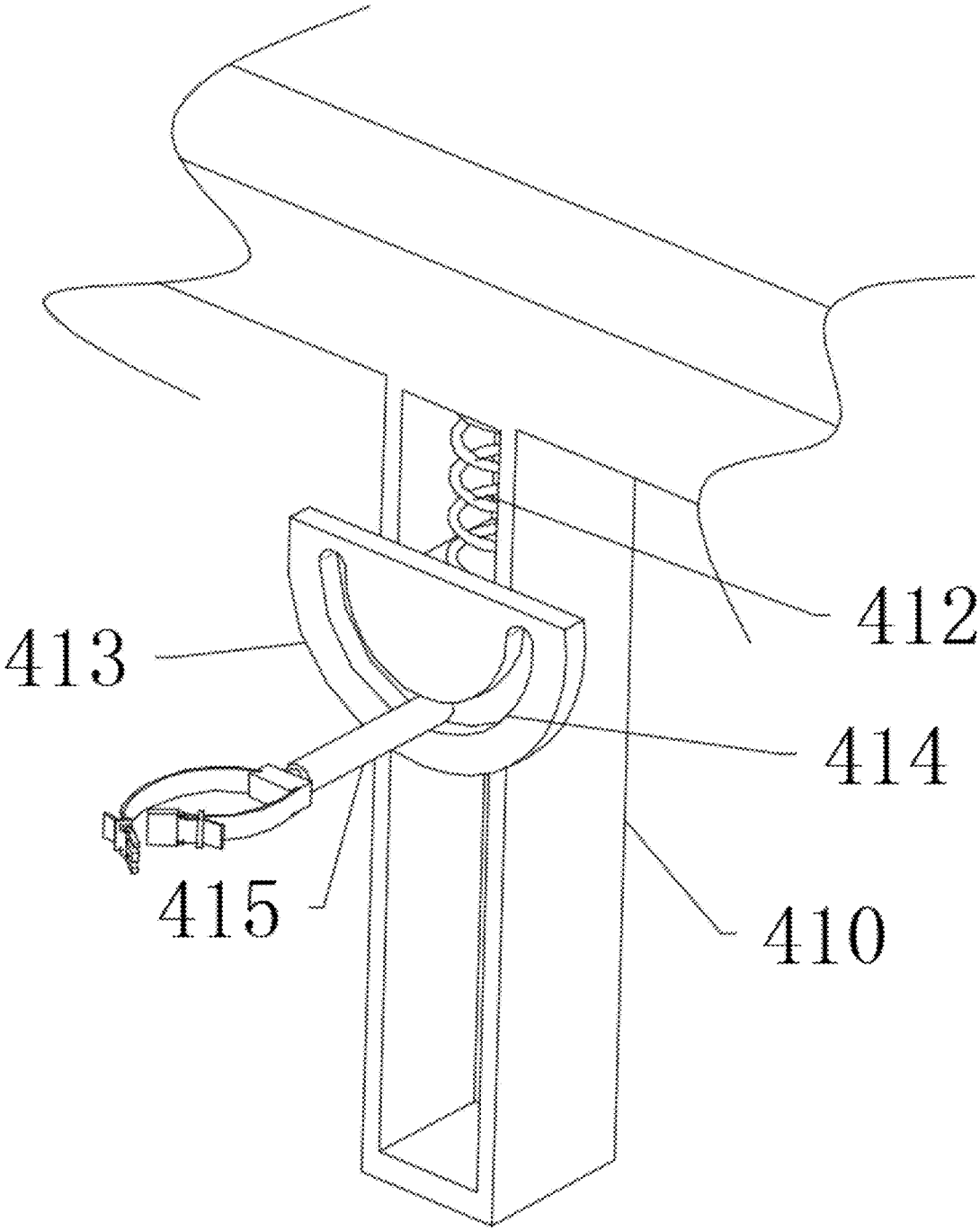
FIG. 7 is a schematic structural view of a foot anti-sprain mechanism of the present disclosure.
Figure 8:
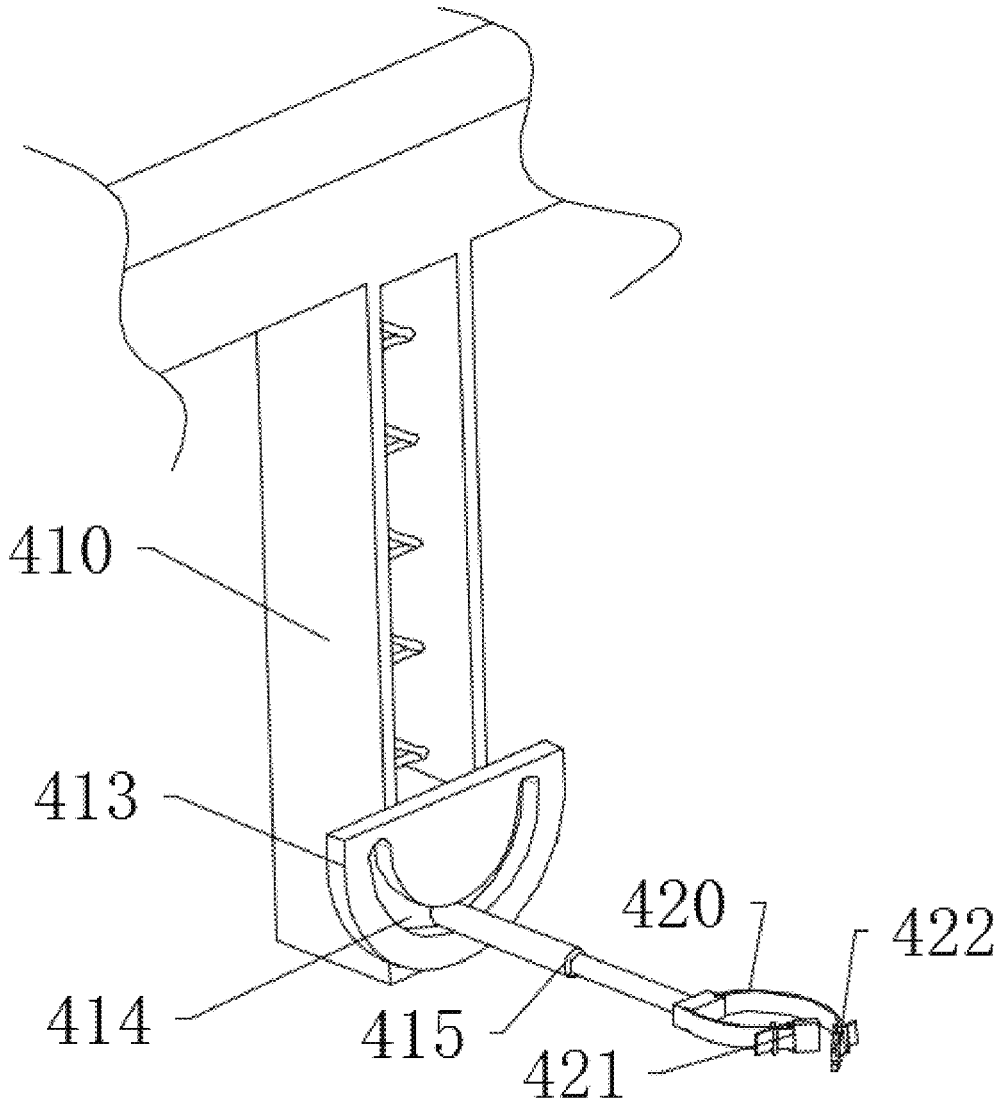
FIG. 8 is a schematic structural view of the foot anti-sprain mechanism from another angle of the present disclosure.

As shown in FIGS. 7-8, in this embodiment, the foot anti-sprain mechanism 400 comprises a third sliding rail 410, an outer wall of the third sliding rail 410 is fixedly connected to the support frame of the treadmill 110, a semicircular frame 413 is slidably inserted into an inner portion of the third sliding rail 410, and a second spring 412 is fixedly connected between an outer wall of the semicircular frame 413 and an inner wall of the third sliding rail 410. An arc-shaped groove 414 is provided on the outer wall of the semicircular frame 413, a third spring telescopic tube 415 is slidably connected within the arc-shaped groove 414, two second fastening straps 420 are fixedly connected to both sides of an outer wall of one end of the third spring telescopic tube 415, a second socket 421 and a second buckle 422 are fixedly connected to one end of the two second fastening straps 420 respectively, and the second socket 421 is in insertion fit with the second buckle 422.

During implementation, the second socket 421 is engaged with the second buckle 422 in insertion fit to fix the second fastening strap 420 to a thigh of the pregnant woman. When the pregnant woman walks, the third spring telescopic tube 415 slides within the arc-shaped groove 414. When the pregnant woman lifts the leg, the pulling force of the second spring 412 effectively reduces the effort exerted by the pregnant woman, enabling the pregnant woman to move more easily. When the pregnant woman lowers the leg, the pulling force of the second spring 412 provides cushioning, ensuring that the foot lands steadily, thus effectively preventing ankle sprains, reducing vibration generated during foot landing, and enhancing comfort for the pregnant woman.

In the description herein, references to terms such as "one embodiment," "example," or "specific example" mean that specific features, structures, materials, or characteristics described in connection with the embodiment or example are included in at least one embodiment or example of the present disclosure. In this specification, schematic expressions of the aforementioned terms do not necessarily refer to identical embodiments or examples. Moreover, the described specific features, structures, materials, or characteristics may be combined in any suitable manner in one or more embodiments or examples.

The foregoing content merely constitutes exemplification and explanation of the present disclosure. Those skilled in the art may make various modifications, supplements, or substitutions using similar means to the described specific embodiments, provided such actions remain within the scope defined by the claims without deviation or transcendence. All such adaptations shall fall within the protection scope of the present disclosure.

What is claimed is:

1. A prenatal activity assistance device, comprising a treadmill, wherein a waist pressure relief mechanism is fixedly connected to a top wall of each of two side support frames of the treadmill, a balance adjustment mechanism is fixedly connected between the two side support frames of the treadmill, and a foot anti-sprain mechanism is fixedly connected to a bottom wall of each of the two side support frames of the treadmill; and the waist pressure relief mechanism comprises a first square housing, an outer wall of the first square housing is fixedly connected to a support frame of the treadmill, a first sliding block is slidably inserted into an inner portion of the first square housing, and a first spring is fixedly connected between an outer wall of the first sliding block and an inner wall of the first square housing, wherein a first spring telescopic tube is fixedly connected to the outer wall of the first sliding block, one end of the first spring telescopic tube is fixedly connected to a first sliding rail, a square rod is slidably inserted into an inner portion of the first sliding rail, and one end of the square rod is fixedly connected to a shoulder strap.

2. The prenatal activity assistance device according to claim 1, wherein one end of the square rod is rotatably connected to a telescopic rod, one end of the telescopic rod is rotatably connected to a telescopic handle, a fixed base is fixedly connected to an outer wall of one end of the telescopic handle, and an outer wall of the fixed base is fixedly connected to the support frame of the treadmill.

3. The prenatal activity assistance device according to claim 2, wherein a first insertion pin is slidably inserted into a sleeve end of the telescopic handle, a plurality of first circular holes are provided on an outer wall of a handle rod of the telescopic handle at equal intervals, and an outer wall of the first insertion pin is slidably inserted into the first circular holes.

4. The prenatal activity assistance device according to claim 3, wherein the balance adjustment mechanism comprises four second sliding rails, an outer wall of each of the second sliding rails is fixedly connected to the support frame of the treadmill, a second sliding block is slidably inserted into an inner portion of two of the second sliding rails, a plurality of second circular holes are provided on both side outer walls of each of the second sliding rails at equal intervals, and a second insertion pin is slidably inserted between the second circular holes and the second sliding block.

5. The prenatal activity assistance device according to claim 4, wherein a second square housing is slidably inserted into an inner portion of the other two second sliding rails, the second insertion pin is slidably inserted into an outer wall of the second square housing, a second spring telescopic tube is fixedly connected to a top wall of an inner portion of the second square housing (320), one end of the second spring telescopic tube is fixedly connected to a square block, an outer wall of the square block is slidably inserted into the inner portion of the second square housing, the outer wall of the square block is fixedly connected to a second traction rope, an outer wall of the second sliding block (312) is fixedly connected to a first traction rope, and a gauze is fixedly connected between one end of the two first traction ropes and one end of the two second traction ropes.

6. The prenatal activity assistance device according to claim 5, wherein two arc-shaped holes are provided at one end of the gauze at equal intervals, a first fastening strap is fixedly connected to both ports of each of the arc-shaped holes, a first socket is fixedly connected to one end of one of the first fastening straps, a first buckle is fixedly connected to one end of the other first fastening strap, and the first socket is in insertion fit with the first buckle.

7. The prenatal activity assistance device according to claim 6, wherein the foot anti-sprain mechanism comprises a third sliding rail, an outer wall of the third sliding rail is fixedly connected to the support frame of the treadmill, a semicircular frame is slidably inserted into an inner portion of the third sliding rail, and a second spring is fixedly connected between an outer wall of the semicircular frame and an inner wall of the third sliding rail.

8. The prenatal activity assistance device according to claim 7, wherein an arc-shaped groove is provided on the outer wall of the semicircular frame, a third spring telescopic tube is slidably connected within the arc-shaped groove, two second fastening straps are fixedly connected to both sides of an outer wall of one end of the third spring telescopic tube, a second socket and a second buckle are fixedly connected to one end of the two second fastening straps respectively, and the second socket is in insertion fit with the second buckle.

* * * * *